US005406677A

United States Patent [19]

Grass

[11] Patent Number: 5,406,677

[45] Date of Patent: Apr. 18, 1995

[54] PRESS-FIT CUP FOR A HINGE

[75] Inventor: Alfred Grass, Konsumstrasse, Austria

[73] Assignee: Grass AG, Hochst Vlbg., Austria

[21] Appl. No.: 105,337

[22] Filed: Aug. 10, 1993

[30] Foreign Application Priority Data

Aug. 20, 1992 [DE] Germany ..... 9211173 U

[51] Int. Cl.[6] ..... E05D 7/12

[52] U.S. Cl. ..... 16/272; 16/384

[58] Field of Search ..... 16/272, 382, 383, 384

[56] References Cited

U.S. PATENT DOCUMENTS 5,239,730 8/1993 Grass ..... 16/384

FOREIGN PATENT DOCUMENTS 1554254 12/1970 Germany .
1559940 3/1972 Germany .
2334246 1/1975 Germany ..... 16/384
2421871 11/1975 Germany ..... 16/384

*Primary Examiner*—P. Austin Bradley
*Assistant Examiner*—Chuck Y. Mah

[57] ABSTRACT

A press-fit hinge cup for a hinge is anchored in a recess in a furniture portion, preferably in a door portion, and the anchoring means consists of tabs which project radially outwardly from the side wall of the hinge cup into the material of the peripheral wall of the recess of the furniture portion. In order to avoid excessive weakening of the material of the peripheral wall of the furniture portion and to ensure secure fitting of the hinge cup in the furniture portion respective upper or distal edges of the tabs are located at different distances from the base of the hinge cup relative to each other. As a result these tabs engage in the peripheral wall of the furniture portion along different contour lines in the recess. Additional splay tabs defined by slits positioned substantially perpendicularly to the hinge cup's base and pressed outwardly into the peripheral wall of the recess may be provided. The splay tabs provide additional resistance to twisting of the hinge cup in the recess.

10 Claims, 1 Drawing Sheet

PRESS-FIT CUP FOR A HINGE

TECHNICAL FIELD

The invention relates to a press-fit hinge cup for a hinge which cup is anchored in a recess in a furniture portion (eg a door) and includes a base and a side wall from which tabs project outwardly to engage a peripheral wall of the recess.

BACKGROUND ART

Hinge cups of the kind discussed above are used to anchor a hinge cup in recess in a furniture portion in a manner allowing load to be placed on the hinge cup.

The term "furniture portion" used hereinafter refers to either a door of a piece of furniture or a side of its carcass. As a rule, however, the hinge cup is normally arranged in the door portion.

Particularly when using so-called rotary cup hinges there is a need to secure the hinge cup, which is anchored in the furniture portion, adequately against twisting. This is because hinge components are connected to the hinge cup by means of a rotary engagement type fastening. The innovation is however not confined to press- fit hinge cups in connection with rotary cup hinges, but relates in general to the secure anchoring of hinge cups in a furniture portion.

Hitherto it is of course known that anchoring of the hinge cup in the furniture portion can be accomplished in such a way that several tabs are splayed radially outwards from the side wall of the hinge cup, in order to engage by their upper or distal edges in the peripheral wall of the recess of the furniture portion. In the previously known anchoring systems, however, the tabs were arranged with their tips or distal edges, which engage the peripheral wall of the furniture portion, all more or less on the same circumferential line in the peripheral wall of the recess in the furniture portion (ie the distance of each said distal edge from the base of the hinge cup is substantially the same). This arrangement has the disadvantage that only in this region (ie along the said circumferential line) did the tabs engage in the peripheral wall of the recess. Hence there is the risk that the material in the region of this circumferential line will become weakened and the fit of the hinge cup in the recess of the furniture portion will consequently not be secured adequately against twisting. There is therefore a risk that with poor material of the furniture portion the hinge cup may come out.

OBJECTS OF THE INVENTIONS

It is therefore an object of the invention to develop a press-fit hinge cup of the kind mentioned hereinbefore in such a way that operationally more reliable anchoring in the furniture portion is ensured even when the furniture portion is of unfavourable eg weak or soft material.

It is a further object of the invention to provide a press-fit hinge cup particularly suitable for engagement by a rotary engagement type fastening of a rotary cup hinge.

It is a further object of the invention to provide a press-fit hinge cup which is easy to manufacture.

SUMMARY OF THE INVENTION

The foregoing objects are met in accordance with the invention by the provision of a press-fit hinge cup for a hinge which cup is adapted to be anchored in a recess in a furniture portion wherein said cup includes a base and a side wall from which tabs project outwardly to engage a peripheral wall of said recess and wherein end edges of said tabs are positioned at different distances from said base of said cup.

It is a characteristic of the invention that the tabs now no longer lie with their upper or distal edges, which engage in the peripheral wall of the recess in the furniture portion, along the same circumferential line, but that these upper edges engage at different heights in the peripheral wall of the recess. This avoids a peripheral weakened region forming in the region of the peripheral wall engaged by the tabs. The tabs are for example stepped after the fashion of a staircase, so that the heights of the upper edges of these tabs, as they engage in the material in the peripheral wall of the recess, have different distances from the base of the hinge cup.

It is preferred if, in relation to a diametral longitudinal centre line of the hinge cup, the tabs are diametrically opposed, in order to ensure mutually opposed, identical regions of engagement of identical tabs. This ensures that, if tabs engage at the same height in the peripheral wall of the recess, these two points of engagement are spaced apart by the maximum possible distance, in order thus to avoid continuous weakening of material in the circumferential direction in the peripheral wall of the recess.

The tabs described serve mainly to prevent the press-fit hinge cup from coming upwardly out of the recess in the furniture portion. As a further means of securely anchoring the hinge cup in the recess in the furniture portion, in a further development of the invention, splay tabs are provided which are pushed out from the side wall of the hinge cup. These splay tabs engage in the peripheral wall of the recess at an angle to the circumferential direction of the hinge cup. The splay tabs serve mainly to prevent twisting of the hinge cup in the recess in the furniture portion. In this way, there is dual locking of the hinge cup in the recess in the furniture portion. Locking to prevent the hinge cup coming out upwardly is provided by the tabs arranged with their upper edges at different heights, and prevention of twisting of the hinge cup is provided by the splay tabs.

Also the distance of these splay tabs from the base of the hinge cup is different to the corresponding distance of the above-mentioned tabs. This ensures that the splay tabs which serve to prevent twisting engage in a different region of the side wall to that engaged by the above mentioned tabs.

Further important characteristics and advantages of the invention are apparent from the accompanying drawings and the description thereof.

BRIEF DESCRIPTION OF THE DRAWINGS

A detailed description of several embodiments of the invention follows which refers to the accompanying figures which show.

DETAILED DESCRIPTION

Figure 1:
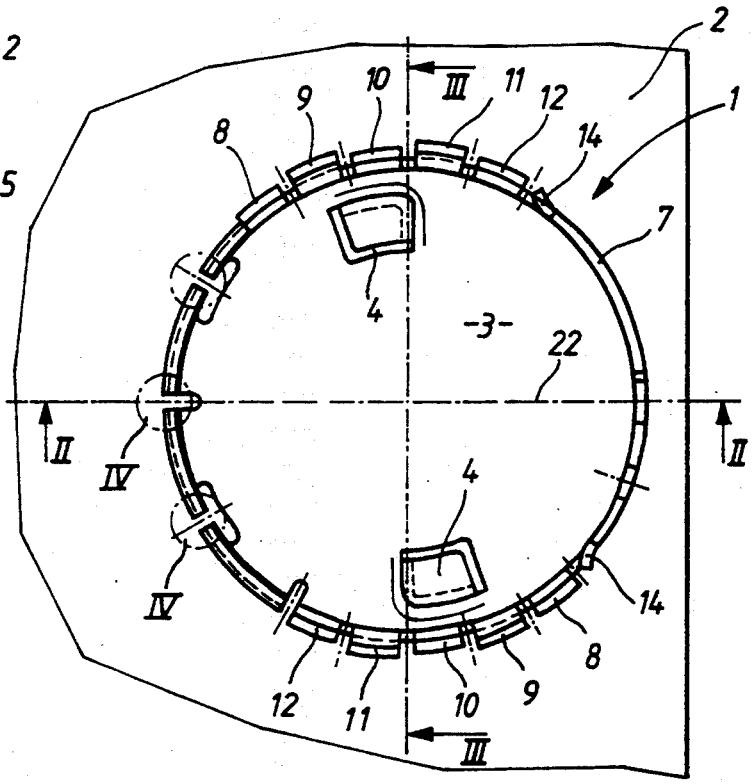
FIG. 1: a plan view of a hinge cup according to the invention.

FIG. 1 shows a hinge cup 1 which is constructed as a press-fit cup inserted in a recess in a furniture portion 2. This hinge cup forms part of a rotary cup hinge which in a manner known in the art consists of a rotatable cup which is rigidly connected to a hinge strap of a hinge (not shown) and which can be connected by a bayonet or rotary engagement type lock to the hinge cup 1 shown in FIGS. 1 to 5. For this purpose, out of the base 3 of the hinge cup 1 are bent tabs 4. Between the tabs 4 and the base 3 recesses 5 are formed in which further tabs (not shown) of the rotary cup (not shown) can be engaged in bayonet fashion by appropriate twisting of the rotary cup.

The hinge cup 1 is anchored by its side wall 7 in the peripheral wall 6 of the furniture portion 2. According to FIGS. 1 to 3, out of the side wall 7 of the hinge cup 1 are formed tabs 8 to 12 which are separated from each other by vertical slits 21. The upper edges 15 of the tabs 8 to 12 are located at different distances 19, 19*a* and 19*b* from the base 3 of the hinge cup 1 with respect to each other.

Figure 2:
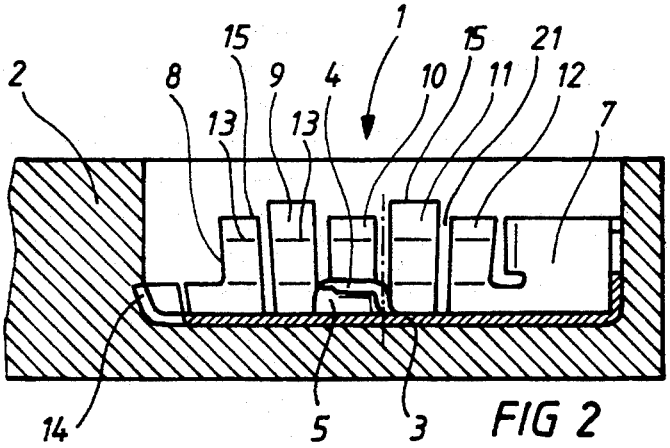
FIG. 2: a transverse cross section on the line II—II in FIG. 1.
Figure 3:
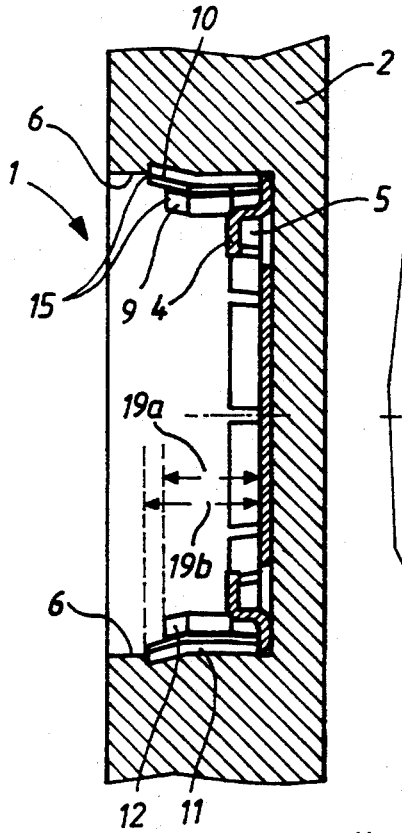
FIG. 3: a transverse cross section on the line III—III in FIG. 1.

Introduction of an expansion tool (not shown) into the hinge cup results in bending along edges 13 of the respective tabs 8 to 12. These edges 13 are located along the same circumferential line. Since the upper or distal edges 15 of the tabs have different distances 19, 19*a* and 19*b* from the base 3 of the hinge cup 1, these upper edges 15 engage the peripheral wall 6 of the recess 5 in the furniture portion 2 along different circumferential lines as shown in FIG. 2. Hence the peripheral wall 6 is loaded along different circumferential lines and there is little or no engagement of material which lies on a single circumferential line. Therefore the hinge cup is securely anchored over a large area of the peripheral wall 6 of the furniture portion 2.

The tabs 8 to 12 act above all, to prevent the hinge cup from coming upwardly out of the recess in the furniture portion 2. They also, however, act as a means to prevent twisting.

As further means to prevent twisting, there are provided splay tabs 14 which are likewise defined by vertical slits 20 in the side wall 7 of the hinge cup 1.

The height of these splay tabs 14 above the base 3 is again different from the corresponding heights 19, 19*a* and 19*b* of the tabs 8 to 12. Therefore it is ensured that the splay tabs 14 are anchored along a different circumferential line in the peripheral wall 6 of the furniture portion 2 than the tabs 8 to 12.

Figure 4:
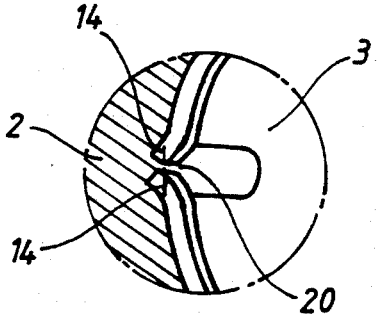
FIG. 4: a sectional detail through the side wall of the hinge cup shown in FIG. 1 at the location IV.

The splay tabs 14 are arranged approximately symmetrically with respect to the diametral longitudinal centre line 22, in the side wall 7, in a given region of the hinge cup, and are spaced apart from each other. Since the splay tabs 14 are bent outwards more or less radially, as shown in FIG. 4, they act mainly as a means to prevent twisting.

The splay tabs 14 are deformed with a suitable expansion tool.

It is also clear from FIG. 1 that the tabs 8 to 12 are diametrically opposed in relation to the longitudinal centre line 22, so that it is ensured that the pairs of tabs 8, 8; 9, 9; 10, 10 etc engaging along the same circumferential lines have the maximum possible distance apart from each other. Thus the distance between the possibly weakened regions in the peripheral side wall 6 of the furniture portion 2 is kept to a maximum.

Figure 5:
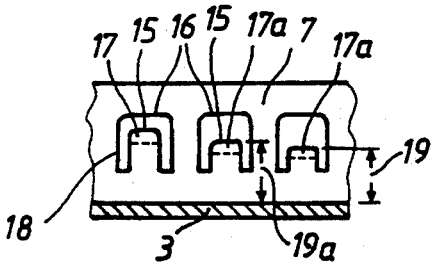
FIG. 5: a detail of an alternative embodiment of a hinge cup showing an interior view of the side wall.

Another embodiment of the shaping of tabs is shown in FIG. 5. The tabs 17, 17*a* and 17*b* are defined in this embodiment by more or less U-shaped slits 18 in the side wall 7 of the hinge cup 1. Outward edges of the slits 18 define recesses 16 in the side wall 7. Here too the upper edges 15 of the tabs 17, 17*a* and 17*b* are arranged at different distances 19 and 19*a* from the base 3 of the hinge cup 1. This again leads to the fact that the tabs pressed radially outwards, out of the recess 16 (in FIG. 5 still undeformed), engage in the peripheral wall 6 of the recess in the furniture portion 2 along different circumferential lines.

Upper edges of the recesses 16 are arranged along the same circumferential line. They may however be arranged along different circumferential lines in the side wall 7 of the hinge cup 1 and the tabs in the recess will then be defined by slits 18 of equal size. This again leads to the result that the upper edges 15 of the resulting tabs will be located at different distances from the base 3 of the hinge cup 1 relative to each other.

With this description of the invention in detail those skilled in the art will appreciate that modifications may be made to the invention without departing from the spirit thereof. Therefore it is not intended that the scope of the invention be limited to the specific embodiments. Rather it is intended that the scope of the invention be determined by the scope of the appended claims. The present invention should also be considered as extending to any novel combination of claims or features disclosed in the specification or abstract.

I claim:

1. A press-fit hinge cup for a hinge which cup is adapted to be anchored in a recess in a furniture portion wherein said cup comprises a base and a side wall extending in a substantially perpendicular plane from said base, said side wall including tabs which project outwardly to engage a peripheral wall of said recess and wherein end edges of said tabs are positioned at different distances from said base of said cup.

2. A hinge cup according to claim 1 wherein said hinge cup forms part of a rotary cup hinge in which an end portion of a hinge strap is connected to a rotary cup which can be mounted by rotation with a rotary engagement type fastening in said hinge cup.

3. A hinge cup according to claim 1 further including splay tabs which engage in said peripheral wall of said recess at an angle to the circumferential direction of said hinge cup and which are pressed out of said side wall of said hinge cup as a further means to prevent twisting of said hinge cup in said recess.

4. A hinge cup according to claim 3 wherein two splay tabs separated by a slit positioned substantially perpendicularly to said cup base in said side wall of said hinge cup are pressed out of said side wall in opposite directions at an angle.

5. A hinge cup according to claim 1 wherein said tabs are separated from each other by slits positioned substantially perpendicularly to said cup base in said side wall of said hinge cup.

6. A hinge cup according to claim 1 wherein identical tabs are diametrically opposed in relation to a longitudinal centre line of said hinge cup.

7. A hinge cup according to claim 1 wherein distal regions of said tabs can be pressed into said peripheral wall of said recess by means of an expansion tool.

8. A hinge cup according to claim 1 wherein said tabs are formed by substantially U-shaped slits in said side wall of said hinge cup which slits define said tabs.

9. A press-fit hinge cup for a hinge which cup is adapted to be anchored in a recess in a furniture portion wherein said cup comprises:

a base;

a side wall extending in a substantially perpendicular plane from said base, said side wall including:

a plurality of tabs which project outwardly to engage a peripheral wall of said recess and have end edges positioned at different distances from said base of said cup, and a plurality of splay tabs pressed out of said side wall of said hinge cup which engage said peripheral wall of said recess at an angle to the circumferential direction of said hinge cup.

10. The hinge cup of claim 9 wherein two splay tabs, separated by a slit positioned substantially perpendicularly to said cup base in said side wall of said hinge cup are pressed out of said side wall in opposite directions at an angle.

* * * * *